US006764799B2

(12) United States Patent
Skorokhod et al.

(10) Patent No.: US 6,764,799 B2
(45) Date of Patent: Jul. 20, 2004

(54) CARRIER COMPOSITIONS

(75) Inventors: Vladislav Skorokhod, Mississauga (CA); Richard P. N. Veregin, Mississauga (CA); Michael S. Hawkins, Cambridge (CA); John G. VanDusen, Sunset Beach, NC (US); Mary L. McStravick, Fairport, NY (US); Deepak R. Maniar, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 16 days.

(21) Appl. No.: 10/176,441

(22) Filed: Jun. 20, 2002

(65) Prior Publication Data

US 2003/0235773 A1 Dec. 25, 2003

(51) Int. Cl.[7] ..... G03G 9/113

(52) U.S. Cl. ..... 430/111.32; 430/111.1; 430/111.35; 430/137.13

(58) Field of Search ..... 430/111.31, 111.32, 430/111.1, 111.35, 137.13

(56) References Cited

U.S. PATENT DOCUMENTS

| | | | | | |
|---|---|---|---|---|---|
| 4,233,387 | A | | 11/1980 | Mammino et al. | 430/137 |
| 4,935,326 | A | | 6/1990 | Creatura et al. | 430/108 |
| 4,937,166 | A | | 6/1990 | Creatura et al. | 430/108 |
| 4,954,409 | A | * | 9/1990 | Aoki et al. | 430/111.1 |
| 5,182,181 | A | * | 1/1993 | Koizumi et al. | 430/111.1 |
| 5,290,654 | A | | 3/1994 | Sacripante et al. | 430/137 |
| 5,376,488 | A | * | 12/1994 | Ohmura et al. | 430/111.35 |
| 5,567,562 | A | | 10/1996 | Creatura et al. | 430/108 |
| 5,631,116 | A | * | 5/1997 | Uchida et al. | 430/111.1 |
| 5,928,830 | A | | 7/1999 | Cheng et al. | 430/137 |
| 5,932,387 | A | * | 8/1999 | Yamamoto et al. | 430/111.1 |
| 6,042,981 | A | | 3/2000 | Barbetta et al. | 430/106.6 |
| 6,355,391 | B1 | | 3/2002 | Van Dusen et al. | 430/111.32 |
| 2002/0177060 | A1 | * | 11/2002 | Matsuda et al. | 430/111.1 |

OTHER PUBLICATIONS

Alger, Mark. Polymer Science Dictionary. New York: Elsevier Applied Science. (1989) pp. 146, 509, 510.*

Webster's II, New Riverside Dictionary. Riverside Publishing Company. (1984) p. 373.*

* cited by examiner

*Primary Examiner*—Christopher Rodee
(74) *Attorney, Agent, or Firm*—E. O. Palazzo

(57) ABSTRACT

A carrier comprised of a core and thereover a polymer coating, and which coating is generated by the emulsion polymerization of one or more monomers and a surfactant, and wherein said polymer coating is of a diameter of equal to or less than about 100 nanometers.

24 Claims, No Drawings

CARRIER COMPOSITIONS

REFERENCE

Illustrated in U.S. Pat. No. 6,355,391, the disclosure of which is totally incorporated herein by reference, a micropowder comprising:

(i) a submicron sized powder recovered from an emulsion of polymer and surfactant;

(ii) a conductive filler incorporated into the powder; and (iii) optional charge enhancing additives incorporated into the powder.

BACKGROUND

The present invention relates to carrier compositions, and more specifically, coated carriers that are substantially free or free of conductive components like conductive carbon blacks. Examples of utility for the aforementioned carriers include their incorporation into copying and printing machines, such as xerographic machines, multifunctional devices, color systems, and the like, and wherein the coated carriers can be economically generated, for example, the blending of a carrier core and micropowder coating.

REFERENCES

The electrostatographic process, and particularly the xerographic process, is known. This process involves, for example, the formation of an electrostatic latent image on a photoreceptor, followed by development of the image with a developer, and subsequent transfer of the image to a suitable substrate. Numerous different types of xerographic imaging processes are known wherein, for example, insulative developer particles or conductive developer particles are selected depending on the development systems used. Moreover, of interest with respect to the aforementioned developer compositions is the appropriate triboelectric charging values associated therewith, as it is these values that may enable continued formation of developed images of high quality and excellent resolution. In two component developer compositions, carrier particles are used in charging the toner particles.

Carrier particles in part are comprised, for example, of a roughly spherical core, often referred to as the "carrier core", which may be generated from a variety of materials, or purchased. The core is typically coated with a resin, such as a polymer or copolymer, and which resin may contain a conductive component, such as certain carbon blacks, to, for example, provide carrier particles with more desirable and consistent triboelectric properties. Including conductive components in the carrier coating may be disadvantageous in some instances, for example, it can be difficult and costly to blend the core and conductive component, and also the conductive component may not fully serve its purposes. For example, processes of incorporating conductive material into carrier coating include the use of electrostatic attraction, mechanical impaction, in situ polymerization, dry blending, thermal fusion and others, and which processes often result in only minimal amounts of conductive material being incorporated into the coating or there is generated conductive carrier coatings too large for effective and efficient use especially with smaller sized carriers. Additionally, dry blending processes and other mixing to incorporate the carbon black or other conductive material into the polymer coating can be selected, however, to avoid, or minimize transfer of the carbon black from the polymer coating the amount of carbon black that may be blended may be limited, for example, to 20 percent by weight or less, which limits the conductivity achievable by the resultant conductive polymer. Also, the carbon black from the carrier coating polymer can contaminate the toner resulting in charges in both charging performance and color of the toner, such as for example, a light colored toner, such as yellow.

In addition to the problems associated with loading conductive materials into coating resins, recent efforts to advance carrier particle science have focused on the attainment of conductive coatings for carrier particles to improve development quality, and provide particles that can be recycled and that do not adversely affect the imaging member in any substantial manner. Many coatings can deteriorate rapidly, especially when selected for a continuous xerographic process where the entire coating may separate from the carrier core in the form of chips or flakes causing failure upon impact or abrasive contact with machine parts and other carrier particles. These flakes or chips, which cannot generally be reclaimed from the developer mixture, have an adverse effect on the triboelectric charging characteristics of the carrier particles, thereby providing images with lower resolution in comparison to those compositions wherein the carrier coatings are retained on the surface of the core substrate.

A further problem encountered with some prior art carrier coatings resides in fluctuating triboelectric charging characteristics, particularly with changes in relative humidity. High relative humidity hinders image density in the xerographic process, may cause background deposits, leads to developer instability, and may result in an overall degeneration of print quality. In the science of xerography, the term "A Zone" refers, for example, to hot and humid conditions, the term "C Zone" refers, for example, to cold and dry conditions. Triboelectric charges are usually lower in the "A Zone" than in the "C Zone." It is desirable to have the measured triboelectric charges ($_{tc}$) for a particular carrier in the A Zone and the C Zone, when entered into a ratio of A zone$_{tc}$/C zone$_{tc}$ to be close to about 1 to obtain development in high humidity.

A carrier coating commonly used is a polymethyl methacrylate (#MP-116 PMMA) available from Soken Chemical of Japan. This powder typically has a diameter of about 0.4 to 0.5 micrometer and it can be generated from polymethyl methacrylate. Usually high amounts of PMMA are selected for the coating of a 30 to 50 micrometer carrier core and to achieve surface area coverage on the carrier of about 85 percent to 95 percent. The use of such high amounts of carrier coating often results in lower carrier yields because, for example, of the formation of fused aggregates. Fused aggregates usually need to be broken up or removed by screening. Crushing or breaking up of the aggregates may result in weak or "chipped off" areas on the carrier surface potentially causing poor coating quality. Screen separation may result in a lower yield as aggregates are removed from the final product.

The above disadvantages and problems can be avoided or minimized with the coated carriers of the present invention in embodiments thereof. More specifically, there is a need to enable the effective, economical incorporation of carrier polymers, especially at certain coating weights, onto carrier cores to permit conductive carriers without the use of an additional conductive components while providing for and maintaining desirable xerographic qualities such as high coating efficiency, proper performance in both the A Zone and the C Zone, and stable charging characteristics.

Carrier particles for use in the development of electrostatic latent images are described in many patents including, for example, U.S. Pat. No. 3,590,000. These carrier particles may consist of various cores, including steel, with a coating thereover of fluoropolymers and terpolymers of styrene, methacrylate, and silane compounds.

There is illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight based on the weight of the coated carrier particles of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 450° F. for a period of about 20 minutes to about 60 minutes, enabling the thermoplastic resin particles to melt and fuse on the carrier core. While the developer and carrier particles prepared in accordance with the process of this patent, the disclosure of which is incorporated herein by reference in its entirety, are suitable for their intended purposes, the conductivity values of the resulting particles are not constant in all instances, for example, when a change in carrier coating weight is accomplished to achieve a modification of the triboelectric charging characteristics. Further, in regard to U.S. Pat. No. 4,233,387, it is believed that only certain triboelectric charging values can be generated, when certain conductivity values or characteristics are contemplated.

U.S. Pat. No. 4,937,166, the disclosure of which is totally incorporated herein by reference, describes a carrier composition comprised of a core with a coating thereover comprised of a mixture of first and second polymers that are not in close proximity thereto in the triboelectric series. The core is described to be iron, ferrites, steel or nickel. The first and second polymers are selected from the group consisting of polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate. The particles are described to, for example, possess a triboelectric charging value of from about −5 to about −90 microcoulombs per gram.

U.S. Pat. No. 4,935,326, the disclosure of which is totally incorporated herein by reference, discloses a carrier and developer composition, and a process for the preparation of carrier particles with substantially stable conductivity parameters which comprises (1) providing carrier cores and a polymer mixture; (2) dry mixing the cores and the polymer mixture; (3) heating the carrier core particles and polymer mixture, whereby the polymer mixture melts and fuses to the carrier core particles; and (4) thereafter cooling the resulting coated carrier particles. These particulate carriers for electrophotographic toners are described to be comprised of core particles with a coating thereover comprised of a fused film of a mixture of first and second polymers which are not in close proximity in the triboelectric series, the mixture being selected from the group consisting of polyvinylidene fluoride and polyethylene; polymethyl methacrylate and copolyethylene vinyl acetate; copolyvinylidene fluoride tetrafluoroethylene and polyethylenes; copolyvinylidene fluoride tetrafluoroethylene and copolyethylene vinyl acetate; and polymethyl methacrylate and polyvinylidene fluoride.

U.S. Pat. No. 5,567,562, the disclosure of which is totally incorporated herein by reference, describes a process for the preparation of conductive carrier particles which comprises mixing a carrier core with a first polymer pair and a second polymer pair, heating the mixture, and cooling the mixture, wherein the first and second polymer pair each contain an insulating polymer and a conductive polymer, and wherein the carrier conductivity thereof is from about $10^{-6}$ to about $10^{-14}$ (ohm-cm)$^{-1}$. The first polymer pair is preferably comprised of an insulating polymethyl methacrylate and a conductive polymethyl methacrylate, and the second polymer pair is preferably comprised of an insulating polyvinylidene fluoride and a conductive polyvinylidene fluoride.

There are illustrated in U.S. Pat. No. 6,042,981, the disclosure of which is totally incorporated herein by reference, carriers including a polymer coating wherein the polymer coating may contain a conductive component, such as carbon black, and which conductive component is preferably dispersed in the polymer coating. The conductive component is incorporated into the polymer coating of the carrier core by combining the carrier core, polymer coating, and the conductive component in a mixing process such as cascade roll mixing, tumbling, milling, shaking, electrostatic powder cloud spraying, fluidized bed, electrostatic disc processing or by an electrostatic curtain. After the mixing process, heating is initiated to coat the carrier core with the polymer coating and conductive component.

There are illustrated in U.S. Pat. No. 5,928,830, the disclosure of which is totally incorporated herein by reference, processes for the preparation of black and color toner compositions. This toner is prepared from latex comprised of a polymer core and a polymer shell thereover. The latex is fused or coalesced together forming toner particles comprised of an aggregation of the latex. Conductive or pigment components may incorporated into the latex cores/shell prior to coalescence by blending a dispersion of the conductive or pigment component in a cationic surfactant with the latex core/shell in an ionic or nonionic surfactant. Specific examples of conductive components incorporated in U.S. Pat. No. 5,928,830 include conductive carbon black SC Ultra available from Conductex Inc. and antimony-doped tin oxide Zelec ECP3005-XC manufactured by E.I. DuPont.

SUMMARY

It is a feature of the present invention in embodiments to provide conductive carriers capable of achieving specific levels of conductivity and high surface area coverage.

It is another feature of the invention in embodiments to provide effective and economical processes for achieving conductive carriers while avoiding conductive components, like carbon black.

It is a further feature of the invention in embodiments to provide coated xerographic carriers that possess, for example, excellent xerographic properties in both the A zone and the C zone for use in toner and developer compositions.

Illustrated herein are carrier micropowders. The micropowder contains, as the primary resin, polymer particles recovered from a latex emulsion polymerization or copolymerization with a surfactant. Conductive materials, and optionally charge enhancing additives, can also be incorporated with the polymer powder to form the micropowder. The micropowder may then be incorporated onto the surface of carrier cores providing in embodiments coated carriers with conductive characteristics, and wherein the carriers are coated with a number of specific polymers, such as SLS (sodium dodecyl sulfate) the surfactant used in the emulsion-polymerization process and TFEMA-MMA a copolymer of trifluoroethyl methacrylate and methyl methacrylate.

Embodiments

Illustrated herein is a carrier comprised of a core and thereover a polymer coating, and which coating is generated by the emulsion polymerization of one or more monomers and a surfactant, and wherein said polymer coating is of a diameter of equal to or less than about 100 nanometers; a carrier wherein the polymer is a polymethyl methacrylate polymer or a copolymer thereof; a carrier wherein the polymer coating is a polymethyl methacrylate trifluoroethyl-methacrylate copolymer; a carrier wherein fluoro-ethyl methacrylate is 2,2,2-trifluoro-ethyl methacrylate; a carrier wherein the carrier polymer coating is polymethyl methacrylate; copoly-trifluoroethyl-methacrylate-methyl methacrylate; polyvinylidene fluoride; polyvinylfluoride copolybutylacrylate methacrylate; copoly perfluorooctylethylmethacrylate methylmethacrylate; or polystyrene; a carrier with a coating of a copolymer of trifluoroethyl-methacrylate and methylmethacrylate containing a sodium dodecyl sulfate surfactant; a carrier wherein the polymer coating possesses a $M_w$ of from about 200,000 to about 10,000,000; and a carrier comprised of a core, and thereover a polymer coating, and which coating is generated by the emulsion polymerization of from about 1 to about 10 monomers and a surfactant, and wherein said polymer coating is of a diameter of from about 10 to about 100 nanometers; submicron polymer coatings obtained by forming a latex emulsion of a polymer and surfactant, and which latex emulsion may be generated by the copolymerization of monomers, including methyl methacrylate, in the presence of an emulsifying agent, such as dodecyl sulfate-sodium salt, wherein submicron refers, for example, to a size diameter of, for example, less than about 1 micrometer, and more specifically, a diameter size of about 100 nanometers, or less, for example, from about 50 to about 75 nanometers as measured by a Coulter-LS measurement.

Also in embodiments of the present Invention there is provided a carrier comprised of a core and thereover a polymer coating, and which coating is generated by the emulsion polymerization of one or. more monomers in the presence of a surfactant and the polymer coating contains the surfactant, and wherein said polymer coating is of a diameter of equal to or less than about 100 nanometers and wherein said coating has a coverage of from about 50 percent to 95, percent, preferably about 85 percent to 95 percent.

Examples of polymers selected for the carrier coating can be synthesized by, for example, emulsion polymerization, reference for example, U.S. Pat. Nos. 6,042,981 and 5,290,654, the disclosures of which are totally incorporated herein by reference. Emulsion polymerization, yielding excellent control over particle size and size distribution, can typically be accomplished by the continuous addition of monomer to a suitable reaction vessel containing water. The reaction vessel is provided with stirring means, and also optionally a nitrogen atmosphere and thermostatic control. The polymerization is affected by heating to, for example, from about 40° C. and about 85° C. (degrees Centigrade) with the addition of an appropriate initiator compound, such as ammonium persulfate. More specifically, the process comprises the following (i) a monomer or monomer mixture of methyl methacrylate and 2,2,2-trifluoroethyl methacrylate is gradually mixed into an aqueous solution of a surfactant such that about 5 to about 30 percent of the total monomer is emulsified while maintaining continuous mixing;

(ii) an initiator like a standard ammonium persulfate solution is added followed by the metered addition of the remaining monomer at a rate of about 0.1 to about 5 grams/minute, and at a mixing speed of about 50 to about 300 revolutions per minute for a number of hours, such as about 1 to about 6 hours;

(iii) the polymer particles can then be recovered by filtering the emulsion with, for example, a cheese cloth;

(iv) the polymer particles can then be optionally washed; and (v) the polymer particles can then be optionally dried by, for example, freeze-drying, spray drying, or vacuum drying.

Examples of polymers generated by the above emulsion processes, and/or which polymers may also be obtained from Soken Chemical (Japan) include methacrylate, acrylate, halogenated, such as fluorinated, acrylates, methacrylates, copolymers thereof, and the like, and more specifically, SLS-TFEMA-MMA, that is the copolymer of trifluoroethyl methacrylate and methyl methacrylate prepared with a sodium lauryl sulfate (SLS) surfactant. Suitable comonomers that may be selected for the polymer coating formation include, for example, monoalkyl or dialkyl amines, such as dimethylaminoethyl methacrylate, diethylaminoethyl methacrylate, diisopropylaminoethyl methacrylate, butylacrylate, acrylic or methacrylic acids, or fluoroalkyl or perfluorinated acrylic and methacrylic esters, such as, for example fluoro-ethyl methacrylate or fluoroethyl acrylates like fluoro-ethyl acrylate-2,2,2-trifluoroethyl methacrylate; small size such as nanometer diameter, 90 nanometer particles of a copolymer of 15 percent by weight of trifluoroethyl methacrylate and 85 percent by weight of methyl methacrylate, prepared with a 1 percent sodium dodecyl sulfate solution; a copolymer of 1 percent by weight of methacrylic acid, 10 percent by weight of n-butylacrylate and 89 percent by weight of methyl methacrylate prepared with a 1 percent sodium dodecyl sulfate solution; a copolymer of 8 percent by weight of methacrylate and 89 percent by weight of methylmethacrylate prepared with a 1 percent sodium of dodecyl sulfate; a copolymer of 14 percent by weight of trifluoroethyl methacrylate, 20 percent by weight of methyl methacrylate, and 66 percent by weight of tert-butyl methacrylate prepared with a 1 percent sodium dodecyl sulfate solution; 80 nanometer particles of a copolymer of 1 percent by weight of methacrylic acid, 10 percent by weight of n-butylacrylate and 89 percent by weight of methyl methacrylate prepared with a 2.5 percent sodium dodecyl sulfate solution; 80 nanometer particles of a copolymer of 2.5 percent by weight of diisopropylaminoethyl methacrylate and 97.5 percent by weight of methyl methacrylate prepared with a 1 percent of sodium dodecyl sulfate; and 150 nanometer polymethyl methacrylate #MP-1451 obtained from Soken (Japan).

In embodiments the monomer or monomer mixture can be gradually mixed into an aqueous solution of a surfactant such that about 5 percent to about 30 percent of the total amount of monomer is emulsified, while maintaining continuous mixing with the initiation of polymeric latex particles formation being accomplished by the rapid addition of a standard ammonium persulfate solution, followed by a metered addition of the remaining monomer supply; the metered rate can be from about 0.1 to about 5 grams per minute, and more specifically, at about 1.5 grams per minute for latex preparations of up to 350 grams. The mixing can be continued after the addition of the final amount of monomer, and the temperature can also be maintained within a range of about 60° C. to about 70° C. The mixing can be performed at a speed of, for example, about 50 to about 300 revolutions per minute for about 1 to about 6 hours using a mechanical mixing apparatus. The dispersion can be mixed at a speed of about 100 to about 200 revolutions per minute for about 2 to about 4 hours, at a temperature of, for example, about 65° C. to about 67° C.

Examples of specific surfactants selected are of the anionic type. Suitable surfactants include sodium dodecylbenzene sulfonate, "SLS" (dodecyl sulfate-sodium salt), dodecyinaphthalene sulfate, and others. The surfactant is added in embodiments in, for example, an amount of about 0.2 percent to about 5 percent by weight of the monomer polymerized; and more specifically, the surfactant SLS is selected in an amount of from about 0.4 percent to about 0.8 percent by weight of the monomer to be polymerized. The initiator is preferably an ammonium persulfate, selected in an amount of, for example, from about 0.2 percent to about 1 percent by weight of the monomer. Surfactant concentration amounts can be selected to regulate latex particle size, while initiator level is used to regulate the molecular weight of the polymer produced. The surfactant selected can be added, for example, in an amount of from about 0.1 percent to about 5 percent by weight of the monomers (corresponding particle size is from about 1 to about 0.01 micrometer); a specific range surfactant amount can from about 0.4 percent to about 0.8 percent by weight of monomer with a particle size of from about 0.25 micrometer to about 0.04 micrometer; the initiator is added in an amount of from about 0.2 percent to about 1 percent by weight of monomer with a corresponding $M_w$ of, for example, from about 200,000 to about 10,000,000, and more specifically, from about 400,000 to about 5,000,000.

The recovery of the polymer particles from the emulsion suspension can be accomplished by processes well known in the art. For example, the emulsion of polymer particles can first be filtered by any suitable material such as a cloth like a cheese cloth is used. The polymer particles can then be washed, however, in embodiments the polymer particles are not washed, thus allowing some amount of the surfactant to remain in association with the conductive polymer particles. Allowing some amount of the surfactant to remain in association with the polymer particles can provide for improved submicron particle formation and excellent carrier coating characteristics. It is believed that the surfactants interplay with the surface chemistry of the polymer particles can in embodiments provide for the aforementioned improved results. Finally, the polymer particles are dried using, for example, freeze drying, spray drying or vacuum techniques. The polymer particles isolated possess, for example, an initial size of, for example, from about 0.01 micrometer to about 1 micrometer. Due primarily to the presence of physical aggregates, some of the polymer particles may initially be larger than about 1 micrometer. During the mixing process with the carrier cores the physical aggregates of the polymer particles will be broken up into submicron polymer particles. Specifically, the polymer particles obtained have a size of, for example, about 0.04 micrometer to about 0.250 micrometer; of about 0.08 micrometer to about 0.120 micrometer, and which particles are well dispersed on the carrier surface as a sub-monolayer to a full monolayer of polymer particulates.

There may be added to the carrier a number of additives, for example charge enhancing additives, such as particulate amine resins, such as melamine, and certain fluoropolymer powders, such as alkyl-amino acrylates and methacrylates, polyamides, and fluorinated polymers, such as polyvinylidine fluoride ($PVF_2$) and poly(tetrafluoroethylene), and fluoroalkyl methacrylates, such as 2,2,2-trifluoroethyl methacrylate. Other charge enhancing additives such as, for example, those illustrated in U.S. Pat. No. 5,928,830, the disclosure of which is totally incorporated herein by reference, including quaternary ammonium salts, and more specifically, distearyl dimethyl ammonium methyl sulfate (DDAMS), bis-1-(3,5-disubstituted-2-hydroxy phenyl)axo-3-(mono-substituted)-2-naphthalenolato(2-) chromate(1-), ammonium sodium and hydrogen (TRH), cetyl pyridinium chloride (CPC), FANAL PINK® D4830, and the like, and others as specifically illustrated therein may also be utilized. The charge additives are added in various effective amounts, such as from about 0.5 percent to about 20 percent by weight, based on the sum of the weights of polymer and charge additive components, and wherein these components may be included by roll mixing, tumbling, milling, shaking, electrostatic powder cloud spraying, fluidized bed, electrostatic disc processing, and an electrostatic curtain, reference for example, U.S. Pat. No. 6,042,981, the disclosure of which is totally incorporated herein by reference, and wherein the carrier coating is fused to the carrier core in either a rotary kiln or by passing through a heated extruder apparatus.

Upon fusing, the sub-monolayer to monolayer of particles fuses into a stable film that is usually thin, for example from about 0.04 micrometer to about 0.250 micrometer, and more specifically, from about 0.08 micrometer to about 0.120 micrometer. The thin polymer coating without the addition of any additional conductive component, such as carbon black, enables a carrier conductivity of, for example, from about $10^{-2}$ S/cm to about $10^{-15}$ S/cm, and more specifically, from about $10^{-11}$ S/cm to about $10^{-13}$ S/cm, as measured by the parallel plate method where the carrier is placed between two steel plate electrodes and compressed by a weight of 4 kilograms; a DC voltage of 10 Volts is applied between the electrodes, and a DC current is measured in series between the electrodes and voltage source after 1 minute following the moment of voltage application; conductivity in S/cm is obtained by dividing current density (i.e., current in Amperes divided by electrode area in $cm^2$) by electric field at 10 Volts (i.e., 10 Volts divided by interelectrode gap thickness in centimeters).

In embodiments, the polymer particles obtained can be used to coat carrier cores of any known type by a number of methods, such as various known methods, and which carriers are then incorporated with a known toner to form a developer for xerographic printing. Suitable carriers cores are illustrated in, for example, U.S. Pat. Nos. 4,937,166 and 4,935,326, the disclosures of which are totally incorporated herein by reference, and may include granular zircon, granular silicon, glass, steel, nickel, ferrites, magnetites, iron ferrites, silicon dioxide, and the like.

Carrier cores with a diameter of, for example, about 5 micrometers to about 100 micrometers may be used. More specifically, the carrier cores are, for example, about 20 micrometers to about 60 micrometers. Most specifically, the carriers are, for example, about 30 micrometers to about 50 micrometers. In an especially preferred embodiment, a 35 micrometer ferrite core available from Powdertech of Japan is used. The preferred ferrite core is a proprietary material believed to be a strontium/manganese/magnesium ferrite formulation.

Typically, polymer coating coverage can be, for example, from about 30 percent to about 100 percent of the surface area of the carrier core with about a 0.1 percent to about a 4 percent coating weight. Specifically, about 75 percent to about 98 percent of the surface area is covered with the micropowder by using about a 0.3 percent to about 1.5 percent coating weight. The use of smaller-sized coating powders may be advantageous as a smaller amount by weight of the coating can be selected to sufficiently coat a carrier core. The use of smaller-sized coating powders also enables the formation of thinner coatings. Using less coating is cost effective and results in less coating amount separating from the carrier to interfere with the triboelectric charging characteristics of the toner and/or developer.

The following Examples are provided, and in these Examples, degrees are in degrees Centigrade.

EXAMPLE I

Poly-trifluoroethyl methacrylate-methyl methacrylate micropowder recovered from the emulsion polymerization of a monomer mixture containing 75 percent (by weight throughout) methyl methacrylate and 25 percent trifluoroethyl-methacrylate with 1 percent SLS (sodium dodecyl sulfate), and freeze dried, and a 35 micrometer ferrite carrier core (0.3 weight percent powder and 99.7 weight percent core) were premixed at 140 to 400 rpm in a M5R Littleford mixer for about 10 to about 60 minutes before being passed through a ZSK30 extruder at 190° C. to fuse the micropowder to the carrier core.

The triboelectric properties of the coated carrier were evaluated in millimeters of average deflection from the zero-field position at 100 Volts/centimeter on the charge spectrograph substrate sheet. The triboelectric properties were measured after mixing 20 grams of carrier in a Turbula mixer with 1 gram of a cyan toner selected from a Xerox DocuCentre® Color 500/500CP, about 90 percent resin and about 10 percent cyan pigment. The toner and the carrier were then conditioned overnight, about 20 hours in A-zone wherein relative humidity was 85 percent RH and temperature was 28° C., and C-zone wherein relative humidity was 15 percent and temperature was 10° C. prior to measurements. Mixing was performed in the corresponding zones. The carrier charge measured after mixing for 2 minutes, 2 hours and 15 hours in the A-zone was −4 millimeters, −2.5 millimeters, and −6.25 millimeters, respectively; in C-zone, −6.3 millimeters, −6.3 millimeters, and −14.3 millimeters, respectively. The charge distribution width measured in millimeters between the minimum and maximum deflection on the charge spectrograph substrate sheet was about 4 millimeters in A-zone and about 5 millimeters in C-zone. It is desirable to have the narrowest distribution width indicating that the developer has the least distribution of charge.

To evaluate carrier conductivity, about 20 to about 50 grams of the carrier were placed between two circular planar parallel steel electrodes (radius=3 centimeters), and compressed by a weight of 4 kilograms to form an about 0.2 to about 0.5 centimeter layer; a DC voltage of 10 volts was applied between the electrodes, and a DC current was measured in series between the electrodes and voltage source after 1 minute following the moment of voltage application; conductivity in S/cm was obtained by dividing current density (i.e., current in Amperes divided by electrode area in $cm^2$) by electric field at 1 volt (i.e., 10 volt divided by interelectrode gap thickness in centimeters). The conductivity measured for the coated carrier of this Example was $1.8\times10^{-12}$ S/cm.

Toner Concentration Latitude (TCL) was determined using a Xerox DC-12 printer in A and C zones. A developer comprising the coated carrier and the above Fuji Xerox DocuCentre® Color 500 cyan toner, at a toner-to-carrier weight ratio of about 2 percent, was pre-conditioned in the corresponding zones. The developer was placed into the DC12 developer housing, and subsequently, in the DC12 printer. A square-wave voltage of between about 100 and about 1,200 volts peak-to-peak with a frequency of about 9 kHz and a duty cycle of between 0.2 and 0.8 was applied between the magnetic roller of the developer housing and the photoreceptor. Moreover, a bias DC voltage of between about 100 volts and about 850 volts was applied between the magnetic roller of the developer housing and the photoreceptor. Developed mass per unit area (DMA) was measured by developing a solid area patch with a known area on the photoreceptor, followed by retrieving the developed toner from the photoreceptor on a MICROPORE® filter with a mini-vacuum pump, and weighing the filter before and after the toner was picked up. Background development was graded by comparing a blank print with a series of background print standards. Then fresh toner, preconditioned in the corresponding environmental zone, was gradually added into the developer housing with an increment of the toner-to-carrier ratio of about 1 percent at a time, and the DMA (Developed Mass per unit Area) and background measurements were repeated. TCL was determined as a difference between the toner-to-carrier ratio where background first is judged unacceptable based on the comparison with a standard set of print samples, minus toner-to-carrier ratio where first DMA falls below 0.4 $mg/cm^2$, which is the minimum required DMA TCL in Example I, was 7.1 percent in A-zone and 7.4 in C-zone. A wider TCL is desirable as it can provide the widest operating latitude for the printer to thereby enable high quality images of sufficient optical density, and low background.

EXAMPLE II

The coated carrier in this Example was identical to that in Example I, except its triboelectric properties were evaluated with a standard Xerox DC12 cyan toner at a toner-to-carrier weight ratio of 7 percent. The carrier charge measured after mixing for 2 minutes, 2 hours and 15 hours in the A-zone was −7 millimeters, −6.3 millimeters, and −6 millimeters, respectively; in C-zone, −10.5 millimeters, −11.8 millimeters, and −11.8 millimeters, respectively. The charge distribution width was about 4 millimeters in A-zone and about 5 millimeters in C-zone.

EXAMPLE III

The coated carrier in this Example was substantially identical to the coated carrier of Example I, except that there was selected a coating weight of 0.5 percent. The carrier charge measured with the above cyan toner was the same as that of Example I; after mixing for 2 minutes, 2 hours and 15 hours in the A-zone, the charge was −4.25 millimeters, −3.5 millimeters, and −3.8 millimeters, respectively; in C-zone, −6 millimeters, −6 millimeters, and −10.8 millimeters, respectively. The charge distribution width was about 3.5 millimeters in A-zone and about 5 millimeters in C-zone. The conductivity measured using the method of Example I was $2\times10^{-13}$ S/centimeters.

EXAMPLE IV

The coated carrier of this Example was generated in a similar manner as the coated carrier of Example III, except there was selected for Example IV a coating polymer comprising only polymethyl-methacrylate at a coating weight of 0.5 percent. The carrier charge measured with the above cyan toner, after mixing for 2 minutes, 2 hours and 15 hours in the A-zone, was −8.5 millimeters, −4 millimeters, and −3.5 millimeters, respectively; in C-zone, −12.5 millimeters, −12 millimeters, and −13 millimeters, respectively. The charge distribution width was about 3 millimeters in A-zone and about 7 millimeters in C-zone. The conductivity measured using the method of Example I was $1.4\times10^{-13}$ S/cm.

EXAMPLE V

The carrier in this Example was prepared in the same manner as the carrier of Example I except that a 3-inch rotary kiln was used at 190° C. to fuse the coating polymer to the carrier core. The conductivity of the carrier was $2.1\times10^{-12}$ S/centimeters.

Commercially available 150 nanometer PMMA powder obtained from Soken Chemical (product ID MP-1451) and a 35 micrometer ferrite carrier core (1 weight percent powder and 99 weight percent core) were premixed at about 140 to about 400 rpm in a M5R Littleford mixer for between about 10 to about 60 minutes before being passed through a ZSK30 extruder at 190° C. to fuse the MP-1451 to the carrier core.

Comparative Example 1

In this Comparative Example, a standard Fuji Xerox DocuCentre® Color 500 carrier, which contains carbon black to control conductivity, was evaluated with the same reference toner as in the above Examples I, III, IV, and V. The carrier charge measured with the cyan toner, after mixing for 2 minutes, 2 hours and 15 hours in the A-zone, was −10.25 millimeters, −7.25 millimeters and −8.75 millimeters, respectively; in C-zone, −12.75 millimeters, −10 millimeters, and −8 millimeters, respectively. The charge distribution width was about 3 millimeters in A-zone and about 4 millimeters in C-zone. The conductivity measured using the method of Example I was $2.5\times10^{-12}$ S/centimeters. The TCL (toner concentration latitude) for this Example was 3.3 percent in A-zone and 4.3 percent in C-zone.

Comparative Example 2

In this Comparative Example, the TCL was measured with a powder-coated carrier comprised of the same ferrite core as in Examples I to V, and a mixture of 0.60 percent SLS-PMMA, 0.072 percent of VULCAN XC72™ carbon black, 0.08 percent Epostar S Melamine beads, and 0.048 percent of KYNAR® fused on a 7" kiln at 190° C., and the same reference toner of Examples I, III, IV, and V. The TCL was 5.9 percent in A-zone and 6.5 percent in C-zone. The conductivity measured for this carrier was $1.4\times10^{-12}$ S/centimeters.

Comparative Example 3

In this Comparative Example, the triboelectric properties of the standard carrier for the above DC12 replenisher were evaluated with the above standard Xerox DC-12 cyan toner at a toner-to-carrier weight ratio of 7 percent (same as in Example II). The carrier charge measured, after mixing for 2 minutes, 2 hours and 15 hours in the A-zone, was −6.25 millimeters, −7.75 millimeters, and −8.75 millimeters, respectively; in C-zone, −12.75 millimeters, −15.5 millimeters, and −13.8 millimeters, respectively. The charge distribution width was about 5 millimeters in A-zone and about 5 millimeters in C-zone.

The data in Table 1 indicate, for example, (i) a TCL increase of the 0.3 percent SLS-PMMA-TFEMA coated carrier compared to the Xerox DC12 and Fuji Xerox DocuCentre® Color 500 carriers;

(ii) a triboelectric charge of Fuji Xerox DocuCentre® Color 500 cyan toner with Fuji Xerox DocuCentre® Color 500 carrier, which decreases after 15 hours aging and which is known to result in background development; contrarily, the micropowder coated carrier of Example I provides appreciable increase in triboelectric charge for the same toner;

(iii) the charging properties with the DC12 toner are close to those of the standard DC12 carrier; and (iv) the conductivity of the micropowder coated carrier of Example I is about equal to that of the Fuji Xerox DocuCentre® Color 500 carrier without any addition of carbon black.

TABLE

| Ex. | Carrier - 35 μm Ferrite Core + Following Coating | Toner | Tribocharge (Negative q/d, mm), C-zone (2 hours/15 hours/width) | Tribocharge (Negative q/d, mm), A-zone (2 hours/15 hours/width) | Carrier Conductivity S/cm | TCL C-zone Percent | TCL A-zone Percent |
|---|---|---|---|---|---|---|---|
| I | 0.3 percent SLS-PMMA-TFEMA | Fuji Xerox DCC 500 cyan | 6.3/14.3/5 | 2.5/6.5/4 | $1.8\times10^{-12}$ | 7.4 | 7.1 |
| II | Same as in Example I | DC12 cyan | 11.8/11.8/5 | 6.3/6/4 | $1.8\times10^{-12}$ | No data | No data |
| III | 0.5 percent SLS-PMMA-TFEMA | Fuji Xerox DCC 500 cyan | 6/10.8/5 | 3.5/3.8/3.5 | $2.0\times1^{-13}$ | No data | No data |
| IV | 0.5 percent SLS-PMMA | Fuji Xerox DCC 500 cyan | 12/13/7 | 4/3.5/3 | $1.4\times10^{-13}$ | No data | No data |
| V | 0.3 percent SLS-PMMA-TFEMA | Fuji Xerox DCC 500 cyan | | | $2.1\times10^{-12}$ | No data | No data |

TABLE-continued

| Ex. | Carrier - 35 μm Ferrite Core + Following Coating | Toner | Tribocharge (Negative q/d, mm), C-zone (2 hours/15 hours/width) | Tribocharge (Negative q/d, mm), A-zone (2 hours/15 hours/width) | Carrier Conductivity S/cm | TCL C-zone Percent | TCL A-zone Percent |
|---|---|---|---|---|---|---|---|
| | (kiln coated) | | | | | | |
| Comp Ex. 1 | Xerox DCC 500 Carrier | Fuji Xerox DCC 500 cyan | 10/8/4 | 7.25/8.25/3 | $.5 \times 10^{-12}$ | 4.3 | 3.3 |
| Comp Ex. 2 | SLS PMMA + CB + Kynar+ Melamine, kiln-coated at 0.8% coating weight | Xerox DCC 500 cyan | | | $1.4 \times 10^{-12}$ | 6.5 | 5.9 |
| Comp Ex. 3 | DC12 | DC12 | 15.5/13.8/5 | 7.8/8.8/5 | Same as in Comp. Ex. 1 | No data | No data |

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A carrier comprised of a core and thereover a polymer coating, and which coating is generated by the emulsion polymerization of one or more monomers in the presence of a surfactant and the polymer coating contains the surfactant, and wherein said polymer coating is of a diameter of equal to or less than about 100 nanometers and wherein said coating has a coverage of from about 50 percent to 95 percent.

2. The carrier in accordance with claim 1 wherein the polymer is a polymethyl methacrylate polymer or a copolymer thereof.

3. The carrier in accordance with claim 1 wherein the polymer is a polymethyl methacrylate trifluoroethyl-methacrylate copolymer.

4. The carrier in accordance with claim 3 wherein the fluoro-ethyl methacrylate is 2,2,2-trifluoro-ethyl methacrylate.

5. The carrier in accordance with claim 1 wherein the carrier polymer coating is polymethyl methacrylate; copolytrifluoroethyl-methacrylate-methyl methacrylate; polyvinylidene fluoride; polyvinylfluoride copolybutylacrylate methacrylate; copolyperfluorooctylethyl methacrylate methyl methacrylate; or polystyrene.

6. The carrier in accordance with claim 1 wherein the polymer is a copolymer of trifluoroethyl-methacrylate and methyl-methacrylate containing a sodium dodecyl sulfate surfactant.

7. The carrier in accordance with claim 1 wherein the monomer is 2,2.2-trifluoro-ethyl methacrylate.

8. The carrier in accordance with claim 1 wherein the conductivity thereof is from about $10^{-2}$ S/cm to about $10^{-15}$ S/cm.

9. The carrier in accordance with claim 1 wherein the carrier conductivity thereof is from about $10^{-11}$ S/cm to about $10^{-}$S/cm.

10. The carrier in accordance with claim 1 wherein the surfactant is anionic.

11. The carrier in accordance with claim 1 wherein the polymer is a copolymer of trifluoroethyl methacrylate and polymethylmethacrylate with from about 70 to about 80 weight percent of polymethylmethacrylate.

12. The carrier in accordance with claim 1 wherein the polymer is a copolymer of trifluoroethyl methacrylate and polymethyl methacrylate with from about 15 to about 30 weight percent of said trifluoro component and from about 70 to about 85 weight percent of said polymethylmethacrylate.

13. The carrier in accordance with claim 1 wherein the carrier core is from about 30 micrometers to about 50 micrometers in diameter.

14. The carrier in accordance with claim 13 wherein about 85 percent to 95 percent of the surface of the carrier core contains said polymer coating.

15. The carrier in accordance with claim 1 wherein the carrier core is a ferrite or a magnetite.

16. The carrier in accordance with claim 15 wherein the carrier core is a ferrite with an optional diameter of about 25 to about 35 micrometers.

17. A developer comprised of the carrier of claim 1 and toner.

18. The developer in accordance with claim 17 wherein carrier polymer coating is a polymethyl methacrylate polymer or a copolymer thereof.

19. The developer in accordance with claim 17 wherein the polymer coating is a polymethyl methacrylate copolymer with fluoro-ethyl methacrylate or fluoro-ethyl acrylate.

20. The developer in accordance with claim 17 wherein said carrier further contains a fluorinated polymer of polyvinylidine fluoride ($PVF_2$), poly(tetrafluoroethylene), or alternatively a fluoroalkyl methacrylate.

21. The developer in accordance with claim 17 wherein said toner is comprised of resin and colorant.

22. The developer in accordance with claim 21 further containing toner additives.

23. A developer in accordance with claim 22 wherein said additives are charge enhancing components.

24. A carrier in accordance with claim 1 wherein one or more is at least two to about seven.

* * * * *